US009447684B2

(12) United States Patent
Kennedy et al.

(10) Patent No.: US 9,447,684 B2
(45) Date of Patent: Sep. 20, 2016

(54) MINE STOPPING PANEL WITH END CAPS AND LOUVER CONNECTIONS

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 513 days.

(21) Appl. No.: 13/969,686

(22) Filed: Aug. 19, 2013

(65) Prior Publication Data

US 2014/0057544 A1 Feb. 27, 2014

Related U.S. Application Data

(60) Provisional application No. 61/692,760, filed on Aug. 24, 2012.

(51) Int. Cl.
*E21F 1/14* (2006.01)

(52) U.S. Cl.
CPC ..... *E21F 1/14* (2013.01)

(58) Field of Classification Search
CPC ..... E21F 1/14
USPC ..... 454/168–172
See application file for complete search history.

(56) References Cited

U.S. PATENT DOCUMENTS

| | | | | |
|---|---|---|---|---|
| 3,499,672 | A | 3/1970 | Sunasky | |
| 3,680,271 | A | 8/1972 | Satchell | |
| 3,719,986 | A | 3/1973 | Ardolino et al. | |
| 3,845,601 | A * | 11/1974 | Kostecky | E04B 1/2403 403/242 |
| 4,193,245 | A * | 3/1980 | Johnson | E04C 2/384 403/231 |
| 4,333,672 | A | 6/1982 | Arthur et al. | |
| 4,397,127 | A | 8/1983 | Mieyal | |
| 4,483,642 | A | 11/1984 | Kennedy et al. | |
| 4,695,035 | A | 9/1987 | Kennedy et al. | |
| RE32,675 | E | 5/1988 | Kennedy et al. | |
| 4,820,081 | A | 4/1989 | Kennedy et al. | |
| 5,394,665 | A | 3/1995 | Johnson | |
| 5,660,012 | A | 8/1997 | Knudson | |
| 5,930,968 | A | 8/1999 | Pullam | |
| 6,568,138 | B1 | 5/2003 | Frost et al. | |
| 7,850,390 | B2 | 12/2010 | Lisbona | |
| 2015/0260041 | A1 * | 9/2015 | Kennedy | E21F 17/103 454/169 |

OTHER PUBLICATIONS

"Tagger 320 Ultralight Stitchfolding Machine for Sheet Material Assembly", Attexor Clinch Systems SA, Ecublens/Lausanne, Switzerland, 2001, 2 pages.

Photos (9) of a mine stopping panel with end caps attached to respective panel members by draw displacement connections and sold by Jack Kennedy Metal Buildings & Products, Inc. more than one year before Aug. 24, 2012.

* cited by examiner

*Primary Examiner* — Steven B McAllister
*Assistant Examiner* — Reginald McNeill, II
(74) *Attorney, Agent, or Firm* — Senniger Powers LLP

(57) ABSTRACT

A mine stopping panel is disclosed. The panel includes first and second channel-shaped panel members having a telescoping sliding fit one inside the other. An end cap is fitted in the first panel member. One or more louver connections between the first panel member and the end cap hold the end cap against movement relative to the first panel member when an extending force is applied to the end cap tending to telescopically extend the first panel member relative to the second panel member.

20 Claims, 14 Drawing Sheets

MINE STOPPING PANEL WITH END CAPS AND LOUVER CONNECTIONS

CROSS-REFERENCE TO RELATED APPLICATION

This application claims priority from U.S. patent application Ser. No. 61/692,760 (provisional), filed Aug. 24, 2012, which is hereby incorporated by reference in its entirety.

FIELD OF THE INVENTION

The present invention generally relates to mine ventilation equipment, and more particularly to mine stopping panels used in mine ventilation systems.

BACKGROUND OF THE INVENTION

Mine stopping panels are used to control the flow of air through mine passages. Mine stopping panels of the type sold by Kennedy Metal Products & Buildings, Inc. are described in U.S. Pat. Nos. 4,483,642, 4,695,035, 4,820,081, and 7,267,505, all of which are incorporated by reference herein. These panels generally comprise first and second sheet metal panel members having a telescoping sliding fit one inside the other, and channel-shaped end caps attached to the panel members at opposite ends of the panel. The panel members are extended to bring seals in the end caps into sealing engagement with the floor and roof of a mine passage. The attachment of the end caps to respective panel members has been achieved in different ways.

One method of attachment was a simple draw-displacement connection in which a punch punches a hole through two sheets (one sheet of the panel member and another sheet of the end cap), shearing on two opposite sides and stretching the other two. The punch goes through both sheets and coins (displaces) the material pushed through against an anvil to make it quite a bit bigger than the slot from which it came. Another method was basic resistance (spot) welding. Still another method involved punching a small hole that was sheared on three sides through both sheets, and then folding the resulting tab back against the bottom of the bottom sheet. Another method was similar to a desk stapler. Very hard wire was forced through the sheets and folded against the bottom sheet. All of these methods have various drawbacks.

There is a need, therefore, for an improved mechanism for attaching the ends caps to respective panel members.

SUMMARY OF THE INVENTION

In general, a mine stopping panel incorporating the improved attachment mechanism of this invention comprises first and second elongate panel members of channel shape, each panel member having a web, first and second flanges at opposite sides of the web, and in-turned lips at outer edges of the flanges. The first and second panel members have a telescoping sliding fit one inside the other along an axis extending lengthwise of the panel members. An elongate first end cap extends between the first and second flanges of the first panel member on an inside surface of the web of the first panel member. The first end cap defines a first cavity for receiving a first end seal for sealing engagement with a first mine surface. A first set of one or more louver connections between the first panel member and the first end cap hold the first end cap against movement relative to the first panel member when an extending force is applied to the first end cap tending to telescopically extend the first panel member relative to the second panel member in a first direction along the axis of the panel members to bring the first seal into pressure engagement with said first mine surface. Each of the one or more louver connections comprises a louver projecting through a louver opening.

A mining stopping panel of this invention also comprises first and second elongate panel members of channel shape, each panel member having a web, first and second flanges at opposite sides of the web, and in-turned lips at outer edges of the flanges. The first and second panel members have a telescoping sliding fit one inside the other along an axis extending lengthwise of the panel members. A first end cap extends between the first and second flanges of the first panel member on an inside surface of the web of the first panel member. A first set of one or more louver connections between the first panel member and the first end cap holds the first end cap against movement relative to the first panel member when an extending force is applied to the first end cap tending to telescopically extend the first panel member relative to the second panel member in a first direction along said axis. Each of the one or more louver connections comprises a louver projecting through a louver opening.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
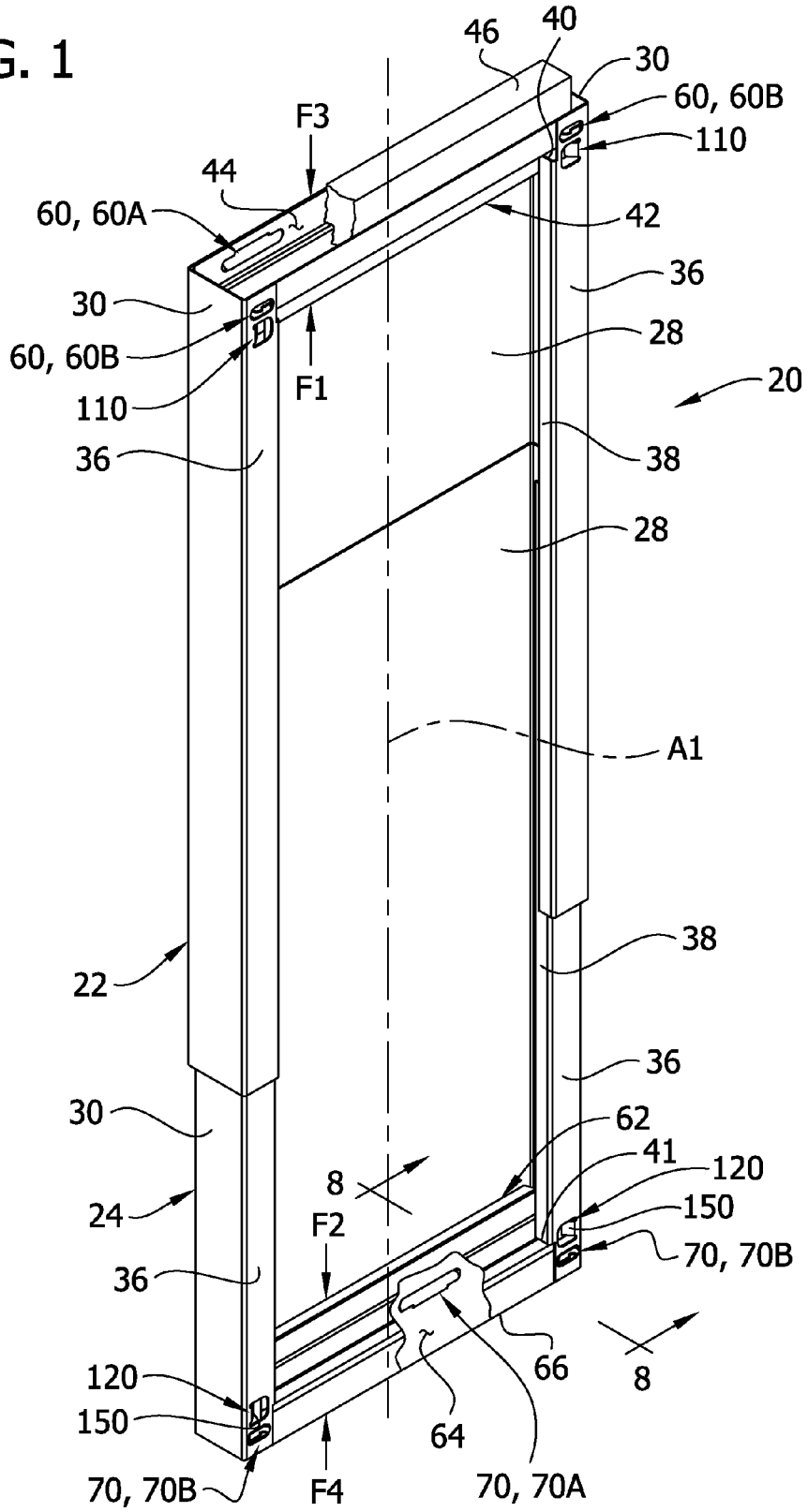
FIG. 1 is a perspective of a mine stopping panel of this invention in which end caps of the panel are attached to respective panel members by louver connections.
Figure 2:
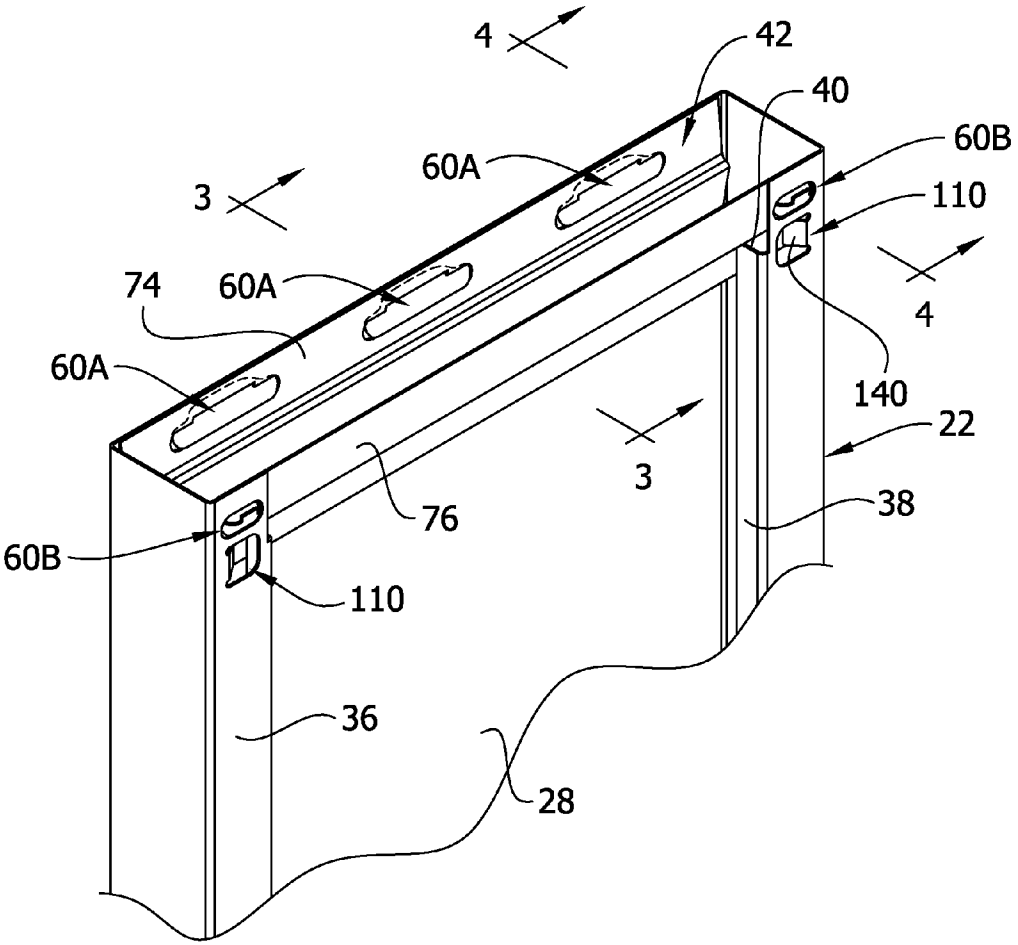
FIG. 2 is an enlarged upper end portion of the stopping panel of FIG. 1, an upper seal being removed from the upper end cap to show details.

Referring to FIG. 1, a mine stopping panel of this invention is designated in its entirety by the reference number 20.

The panel comprises first (upper) and second (lower) elongate panel members 22, 24 of channel shape. Each panel member 22, 24 has a web 28, first and second flanges 30 at opposite sides of the web, and in-turned lips 36 at outer edges of the flanges. In the illustrated embodiment, the in-turned lips have edge margins 38 bent back toward the web 28 in a direction generally parallel to the flanges 30. The edge margins 38 of the upper panel member 22 have upper end edges 40 terminating short of the upper end of the panel member 22. Similarly, the edge margins of the lower panel member 24 have lower end edges 41 terminating short of the lower end of the panel member 24. The first and second panel members have a telescoping sliding fit one inside the other along an axis A1 extending lengthwise of the panel members 22, 24. Desirably, the panel members 22, 24 are formed from sheet metal or other suitable material.

An elongate first end cap, generally designated 42, extends between the first and second flanges 30 of the first (upper) panel member 22 on an inside surface of the web 28 of the first panel member at an upper end of the panel 20. In general, the first end cap 42 has a length sized for a relatively loose fit between the flanges 30 of the upper panel member 22, and a width at its top sized for a relatively loose fit between the web 28 of the panel member and the in-turned lips 36 of the panel member 22. (The relatively loose fit provides room for the panel member 22 to contract horizontally in the event of pillar expansion. That is, the flat web 28 of the panel member can buckle outward.) The first end cap 42 defines a first cavity 44 for receiving a first end seal 46 for sealing engagement with a first mine surface, such as the roof of a mine passage. A first set of one or more louver connections, each generally indicated at 60, between the first panel member 22 and the first end cap 42 hold the first end cap against movement relative to the first panel member 22 when an extending force F1 (FIG. 1) is applied to the first end cap tending to telescopically extend the first panel member relative to the second panel member 24 in a first direction (typically vertically upward) along the axis A1 of the panel members to bring the first end seal 46 into pressure engagement with the first mine surface (e.g., the roof of a mine passage). A jack may be used to generate the extending force, as described in co-assigned U.S. Pat. No. 7,267,505. Other extension mechanisms may also be used.

Similarly, an elongate second end cap, generally designated 62, extends between the first and second flanges 30 of the second panel member 24 on an inside surface of the web 28 of the second panel member at a lower end of the panel 20 (see FIG. 1). In general, the second end cap 62 has a length sized for a relatively loose fit between the flanges 30 of the lower panel member 24, and a width at its bottom sized for a relatively loose fit between the web 28 of the panel member 24 and the in-turned lips 36 of the panel member. (The relatively loose fit provides room for the panel member 24 to contract horizontally in the event of pillar expansion. That is, the flat web 28 of the panel member can buckle outward.) The second end cap 62 defines a second cavity 64 for receiving a second end seal 66 for sealing engagement with a second mine surface, such as the floor of a mine passage. A second set of one or more louver connections, each generally indicated at 70, between the second panel member 22 and the second end cap 62 hold the second end cap against movement relative to the second panel member 22 when an extending force F2 (FIG. 1) is applied to the second end cap tending to telescopically extend the second panel member 24 relative to the first panel member 22 in a second direction (typically vertically downward) along the axis A1 of the panel members to bring the second end seal 66 into pressure engagement with the second mine surface (e.g., the floor of a mine passage). As noted above, the jack described in co-assigned U.S. Pat. No. 7,267,505 may be used to apply the extending force. Alternatively, other extension mechanisms may be used.

Figure 4:
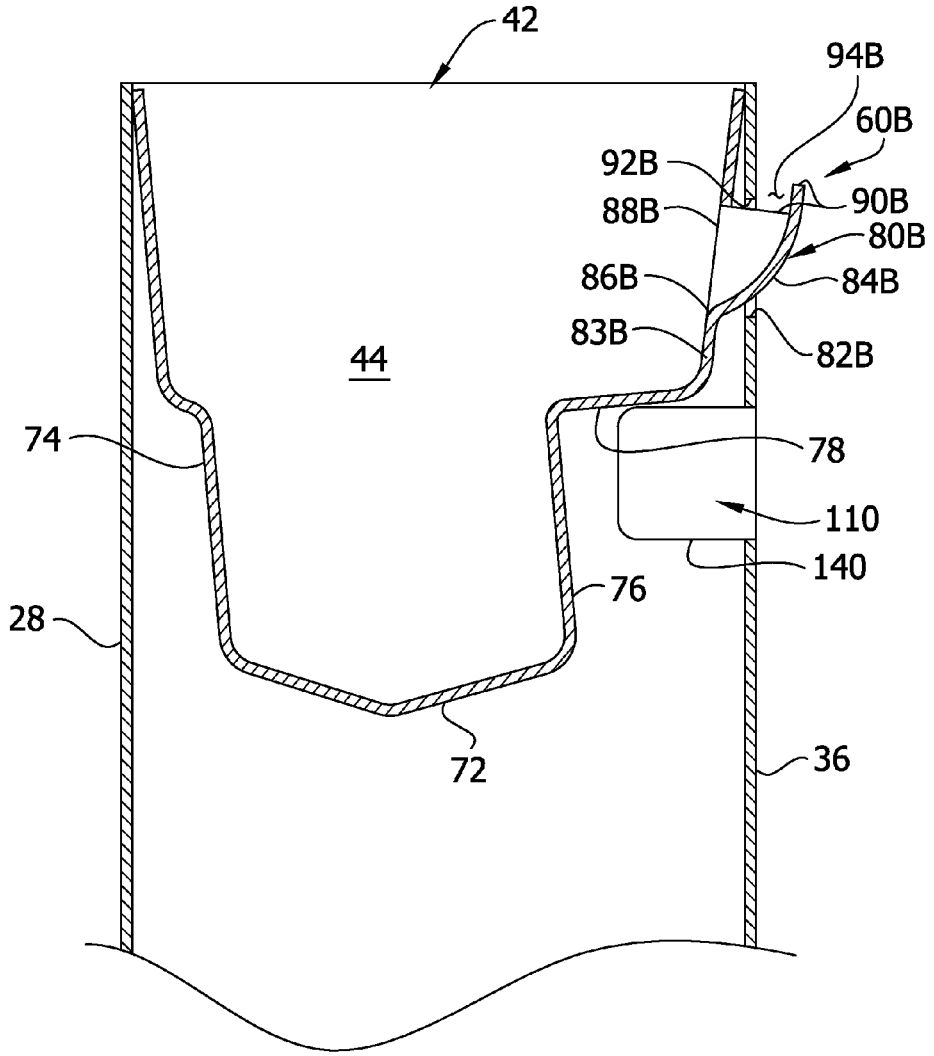
FIG. 4 is an enlarged vertical section taken in the plane of line 4-4 of FIG. 2.
Figure 8:
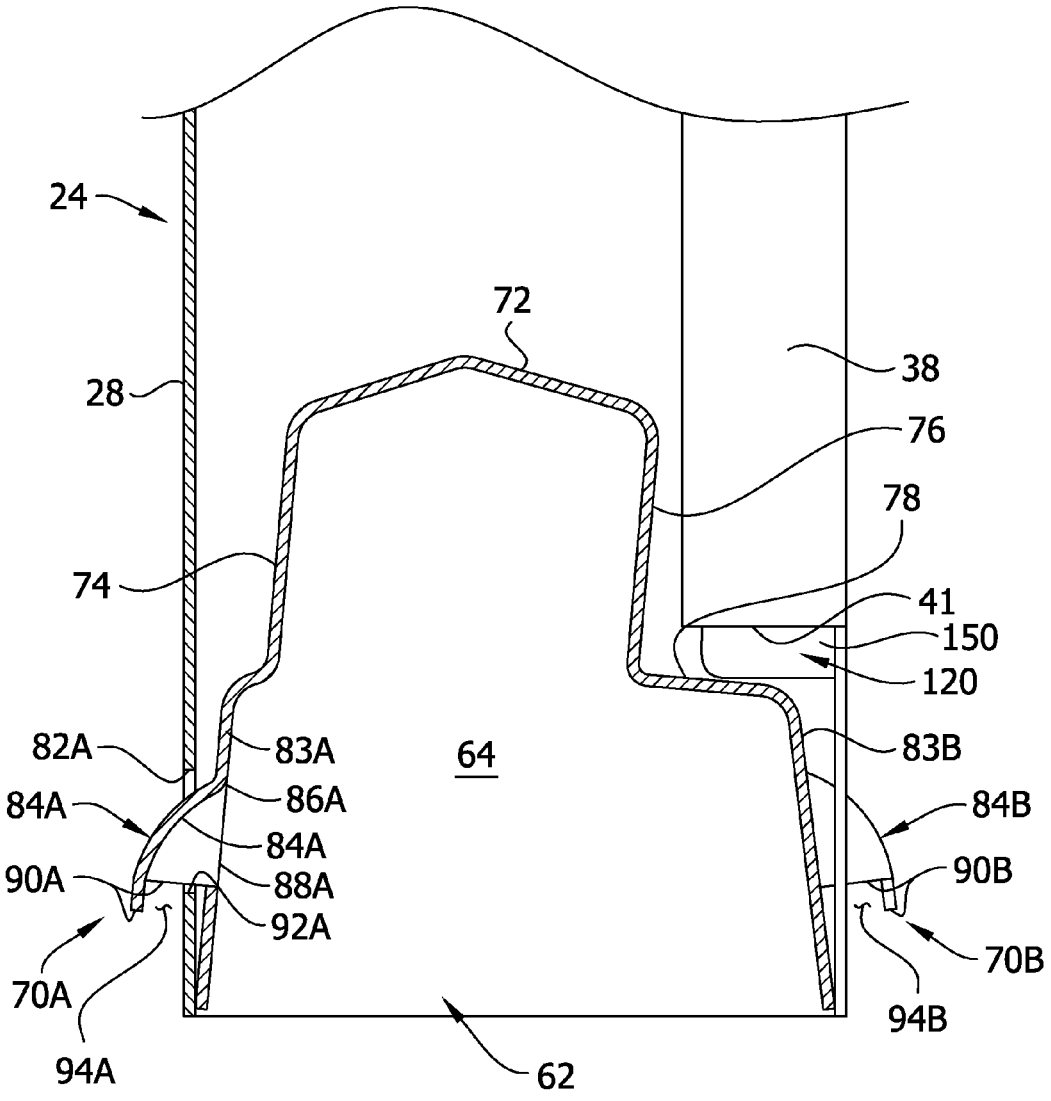
FIG. 8 is an enlarged vertical section taken in the plane of line 8-8 of FIG. 1, but with an end seal removed from the end cap for clarity.
Figure 9:
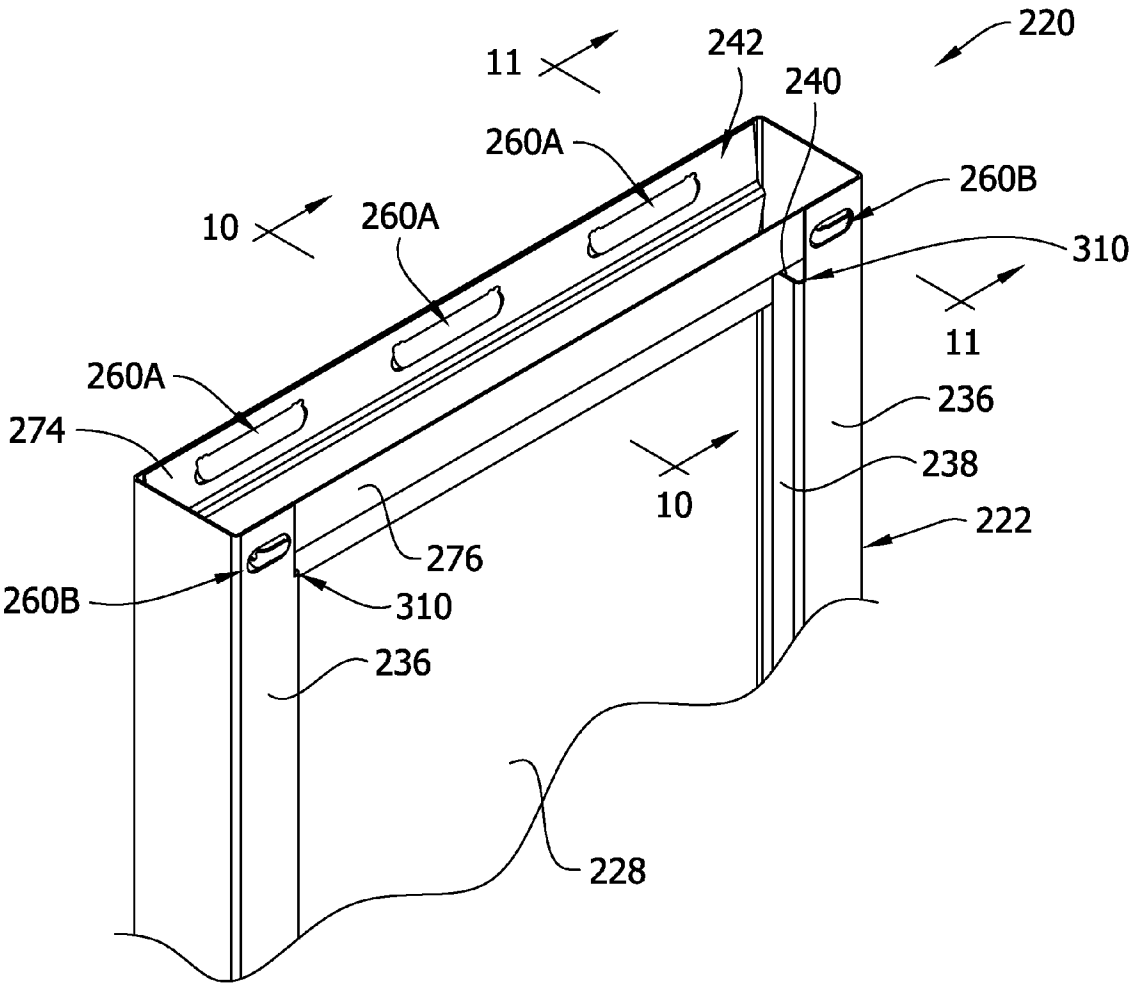
FIG. 9 is a partial perspective of an upper end portion of a second embodiment of a stopping panel having louver connections of an alternative design.

Desirably, the end caps 42, 62 are also formed (e.g., stamped) from sheet metal or other suitable material. As best illustrated in FIGS. 4 and 8, each end cap 42, 62 has the shape of a channel comprising a base wall 72 and first and second opposite side walls 74, 76 extending from the base wall. The walls 72, 74, 76 define the respective cavity 44, 64 for receiving the respective end seal 46, 66. The second side wall 76 of each end cap 42, 62 is formed with a generally horizontal shoulder 78.

Referring to FIGS. 1-4, the first set of one or more louver connections 60 connecting the first (upper) end cap 42 to the first panel member 22 comprises at least one and desirably more than one louver connection 60A between the first side wall 74 of the first end cap 42 and the web 28 of the first panel member, and at least one and desirably more than one louver connection 60B between the second side wall 76 of the first end cap and the in-turned lips 36 of the first panel member. Each louver connection 60A comprises a louver, generally designated 80A, on the first end cap 42 projecting outward through a louver opening 82A in the side wall 74 of the first panel member 22 (see FIG. 6). Similarly, each louver connection 60B comprises a louver, generally designated 80B, on the first end cap 42 projecting outward through a louver opening 82B in the second side wall 76 of the first panel member 22 (see FIG. 7).

Figure 3:
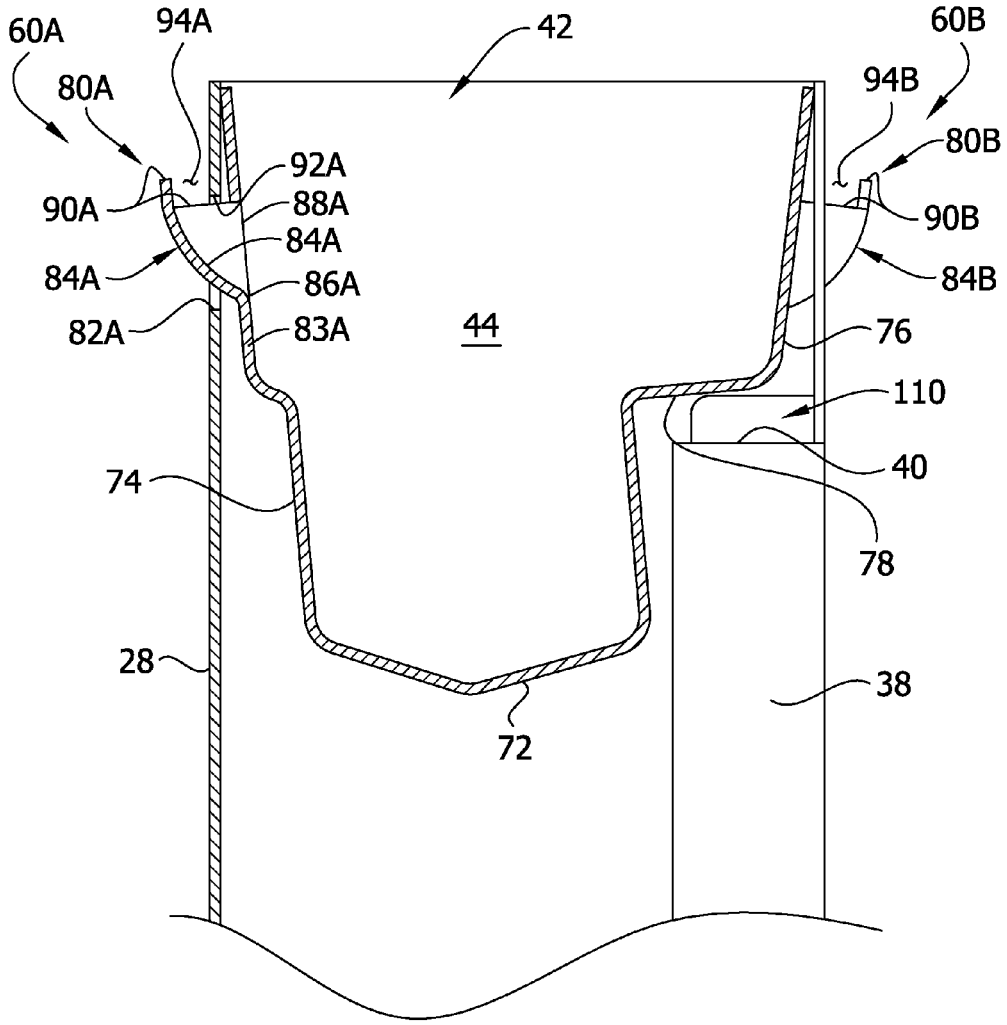
FIG. 3 is an enlarged vertical section taken in the plane of line 3-3 of FIG. 2.

Referring to FIG. 3, the louver 80A of each louver connection 60A is struck from a first region 83A of the end cap 42 (e.g., a planar region of the first side wall 74). The louver 80A comprises a louver body 84A having a base edge 86A integrally joined to the region 83A, opposite sides edges 88A integrally joined to the region 83A, and a free edge 90A opposite the base edge 86A integrally joined to respective opposite side edges 88A of the louver body. The free edge 90A projects outward from the first region 83A for engagement by an opposing edge 92A of the louver opening 82A in the first panel member 22. Desirably, the free edge 90A is configured to define a slot 94A for receiving the edge 92A of the louver opening 84A so that the edge 92A is held captive in the slot 94A in a seated position against the free upper edge 90A of the louver body 84A. In the embodiment of FIG. 3, opposite upper end portions of louver body 84A are recessed (e.g., cut away) such that the free upper edge 90A has depressed substantially straight opposite end segments and an elevated middle segment that combine to define the slot 94A. The edge 92A of the louver opening 84A seats against the depressed end segments.

Similarly, as illustrated best in FIG. 4, the louver 80B of each louver connection 60B is struck from a second region 83B of the end cap 42 (e.g., a planar region of the second side wall 76). The louver 80B comprises a louver body 84B having a base edge 86B integrally joined to the region 83B, opposite sides edges 88B integrally joined to the region 83B, and a free edge 90B opposite the base edge having opposite ends integrally joined to respective opposite side edges 88B of the louver. The free edge 90B projects outward from the second region 83B for engagement by an opposing edge 92B of the corresponding louver opening 82B in the second panel member 22. Desirably, the free edge 90B is recessed to define a slot 94B for receiving the edge 92B of the louver opening 84B so that the edge 92B is held captive in the slot 94B in a seated position against the free upper edge 90B of the louver body 84B. In the embodiment of FIG. 4, opposite upper end portions of louver body 84B are recessed (e.g., cut away) such that the free upper edge 90B has depressed substantially straight opposite end segments and an elevated middle segment that combine to define the slot 94B. The edge 92B of the louver opening 84B seats against the depressed end segments.

The louver connections 60A, 60B hold the first end cap 42 in a stable position against movement relative to the first panel member 22 when the aforesaid extending force is applied to the first end cap 42. Desirably, the reception of the edges of the louver openings 84A, 84B in respective slots 94A, 94B, minimizes rotation (roll) of the end cap 42 relative to the respective panel member 22.

The louver connections 70A, 70B between the lower end cap 62 and the lower panel member 24 are configured in the same way.

Referring to FIGS. 1 and 8, the second set of one or more louver connections 70 connecting the second (lower) end cap 62 to the second panel member 24 comprises at least one louver connection 70A between the first side wall 74 of the second end cap 62 and the web 28 of the second panel member, and at least one louver connection 70B between the second side wall 76 of the second end cap and the in-turned lips 36 of the second panel member. The louver connections 70A, 70B are constructed in the same manner as louver connections 60A and 60B, respectively, and corresponding elements of the connections are designated by corresponding reference numbers.

The louver connections 60, 70 described above comprise louvers on respective end caps 42, 62 projecting outward through louver openings in respective panel members 22, 24. However, it will be understood that this arrangement could be reversed. That is, the louvers could be on respective panel members 22, 24 and project inward through louver openings in respective end caps 42, 62.

Figure 6:
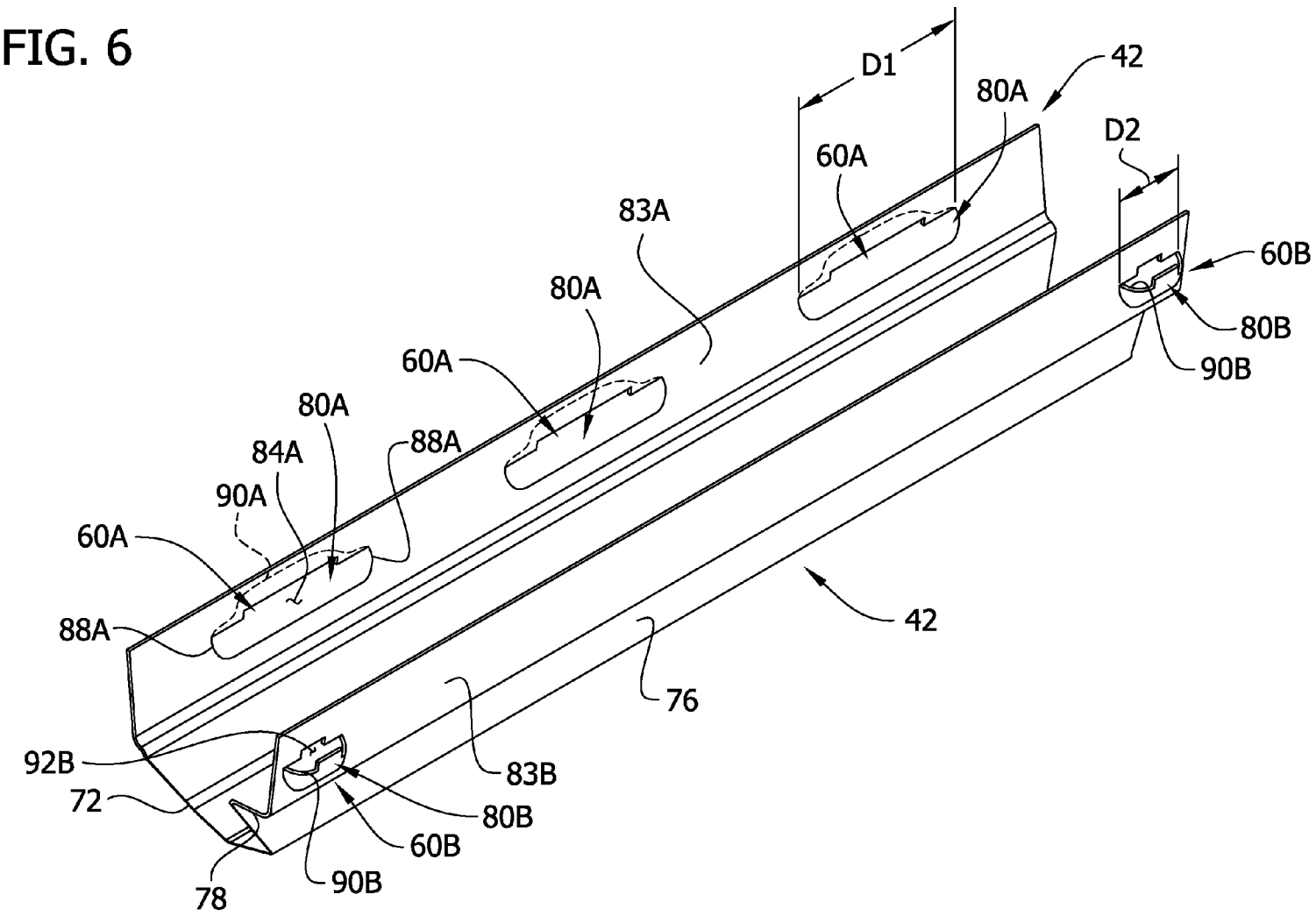
FIG. 6 is a perspective of an upper end cap of the stopping panel.
Figure 7:
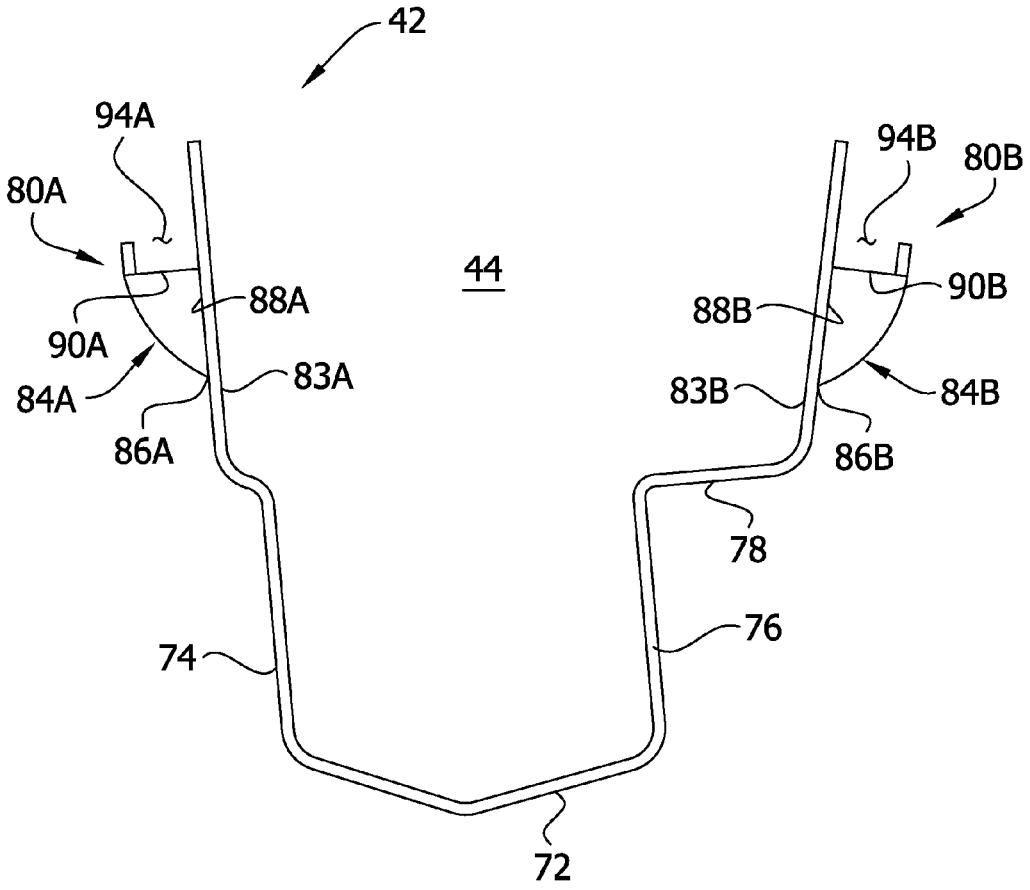
FIG. 7 is a left end elevation of the upper end cap of FIG. 6.

The number of louver connections 60A, 60B, 70A, 70B will vary depending on strength needed to maintain the attachment between the end caps 42, 62, and respective panel members 22, 24 when forces F1, F2 are applied to the end caps (as by the aforementioned jack) to extend the panel members relative to one another to bring the end seals 46, 66 into sealing engagement with opposing surfaces (e.g., roof and floor) of a mine passage. Also, the size and configuration of the louver connections 60A, 60B, 70A, and 70B can vary as needed or desired. For example, the length of the louvers 80A, 80B can vary from one louver connection to another louver connection. By way of example, as shown in FIG. 6, the louvers 80A of the louver connections 60A may have a relatively long side-to-side dimension D1 (e.g., 1.75 in), while the louvers 80B of louver connections 60B may have a shorter side-to-side dimension D2 (e.g., 0.75 in).

It will be observed that the first set of one or more louver connections 60A, 60B does not hold the first end cap 42 against movement relative to the first panel member 22 when a contracting force F3 (FIG. 1) is applied to the first end cap tending to telescopically contract the first panel member 22 relative to the second panel member 24 in a second (downward) direction along the axis A1 opposite a first (upward) direction. Similarly, the second set of one or more louver connections 70A, 70B does not hold the second end cap 62 against movement relative to the second panel member 24 when a contracting force F4 (FIG. 1) is applied to the second end cap tending to telescopically contract the second panel member 24 relative to the first panel member 22 in a second (upward) direction along the axis A1 opposite the aforesaid first (downward) direction. Contracting forces F3 and F4 may be applied to one or both panel members 22, 24 during the process of assembling, shipping, and/or installing the panels 22.

Referring again to FIG. 1, at least one stop, generally designated 110, is provided on the first panel member 22 configured for engagement by the first end cap 42 to limit telescopic movement of the first end cap relative to the first panel member when a contracting (downward) force F3 is applied to the first end cap. Two such stops 110 are shown in FIG. 1. Similarly, at least one stop, generally designated 120, is provided on the second panel member 24 configured for engagement by the second end cap 62 to limit telescopic movement of the second end cap relative to the second panel member 24 when a contracting (upward) force F4 is applied to the second end cap. Two such stops 120 are shown in FIG. 1.

Figure 5:
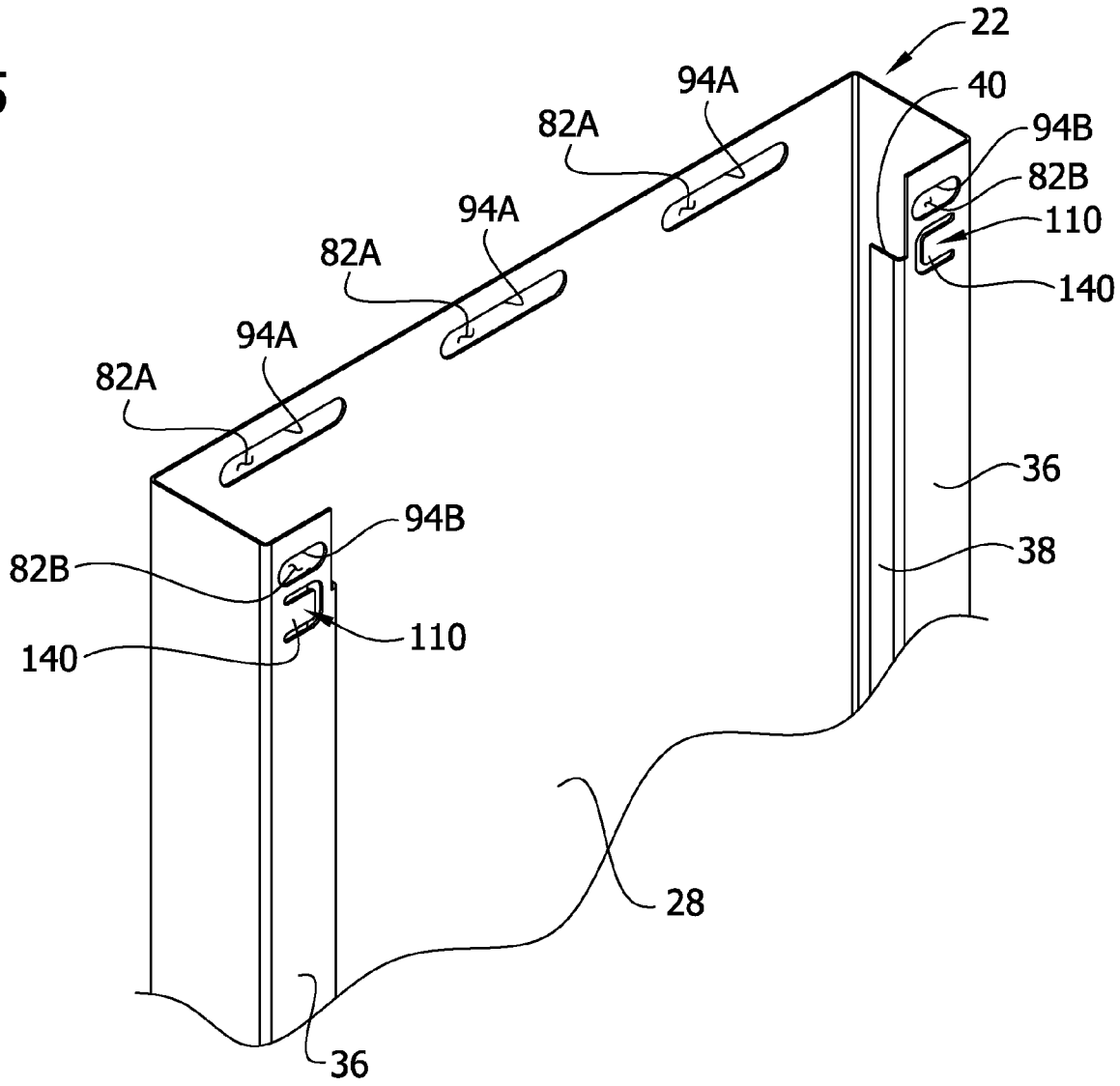
FIG. 5 is a partial perspective of an upper panel member of the stopping panel of FIG. 1.

Referring to FIGS. 1, 4, and 5, each stop 110 comprises a tab 140. Desirably, each tab 140 is formed as an integral part of the first panel member 22. The tabs 140 can be bent from the initial positions shown in FIG. 5 to the stop positions shown in FIGS. 1 and 4 in which they are positioned for engagement by the shoulder 78 of the first end cap 42 to limit telescopic movement of the first end cap relative to the first panel member 22 when the contracting (downward) force F3 is applied to the first end cap. Similarly, as shown in FIGS. 1 and 8, each stop 120 comprises a tab 150 formed as an integral part of the second panel member 24. The tabs 150 can be bent from a position generally co-planar with flanges 36 to the position shown in FIGS. 1 and 8 for engagement by the second end cap 62 to limit telescopic movement of the second end cap relative to the second panel member 24 when the contracting (upward) force F4 is applied to the second end cap.

FIGS. 9-14 illustrate a second embodiment of a mine stopping panel of this invention, generally designated 220. The panel is similar to the stopping panel 20 of the first embodiment, and corresponding elements are designated by corresponding reference numbers increased by 200. The stopping panel 220 is different from panel 20 in two respects.

Figure 10:
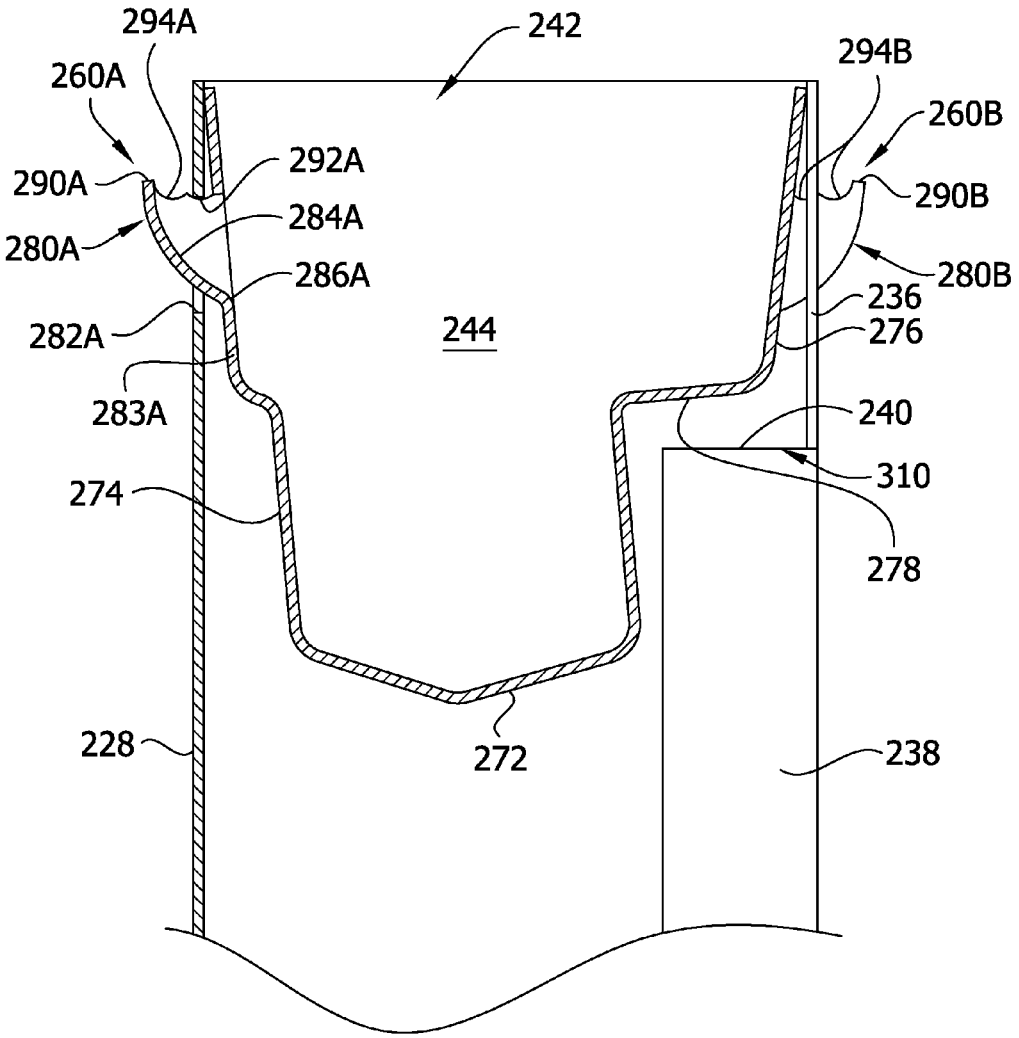
FIG. 10 is an enlarged vertical section taken in the plane of line 10-10 of FIG. 9.
Figure 11:
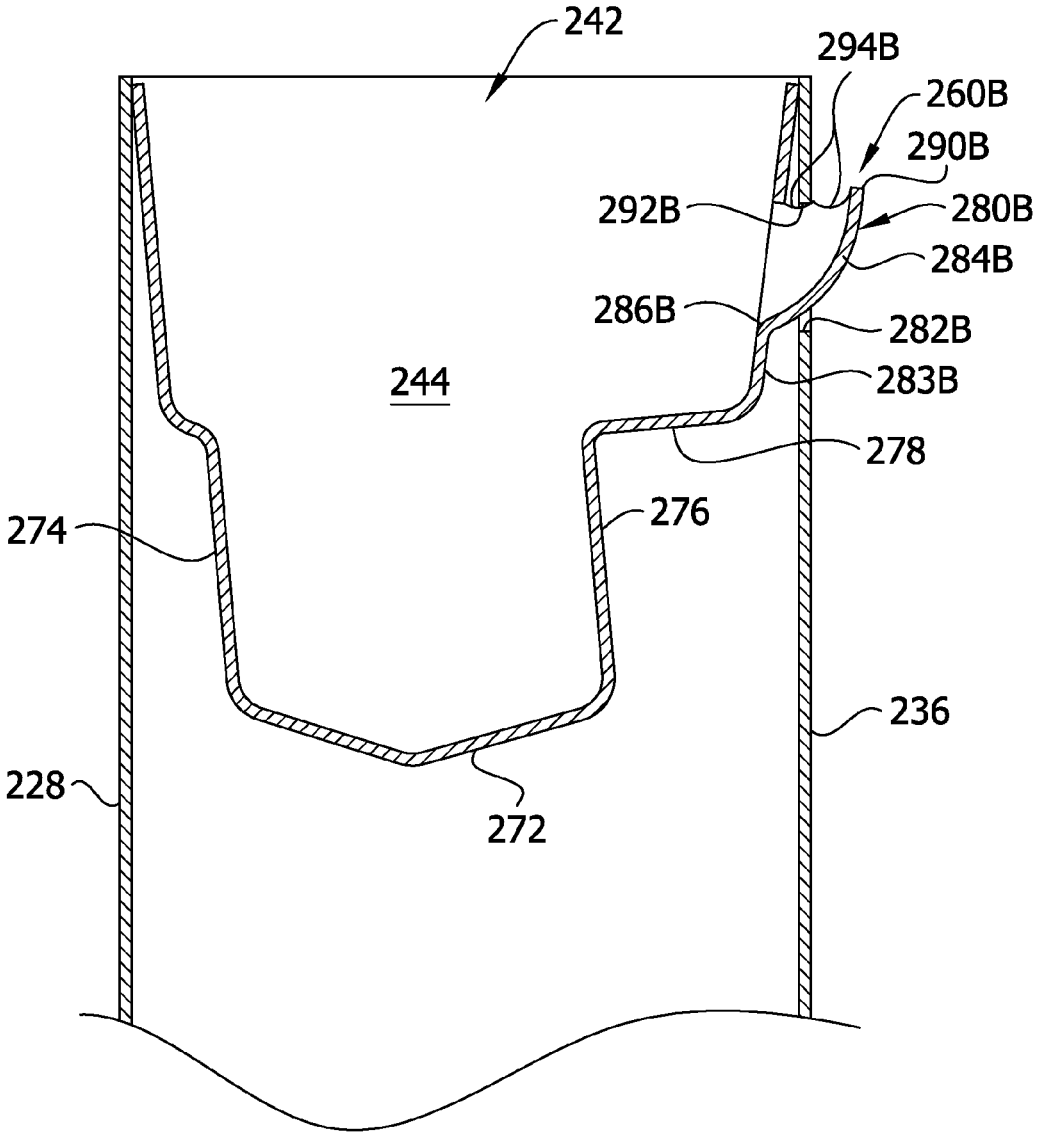
FIG. 11 is an enlarged vertical section taken in the plane of line 11-11 of FIG. 9.
Figure 12:
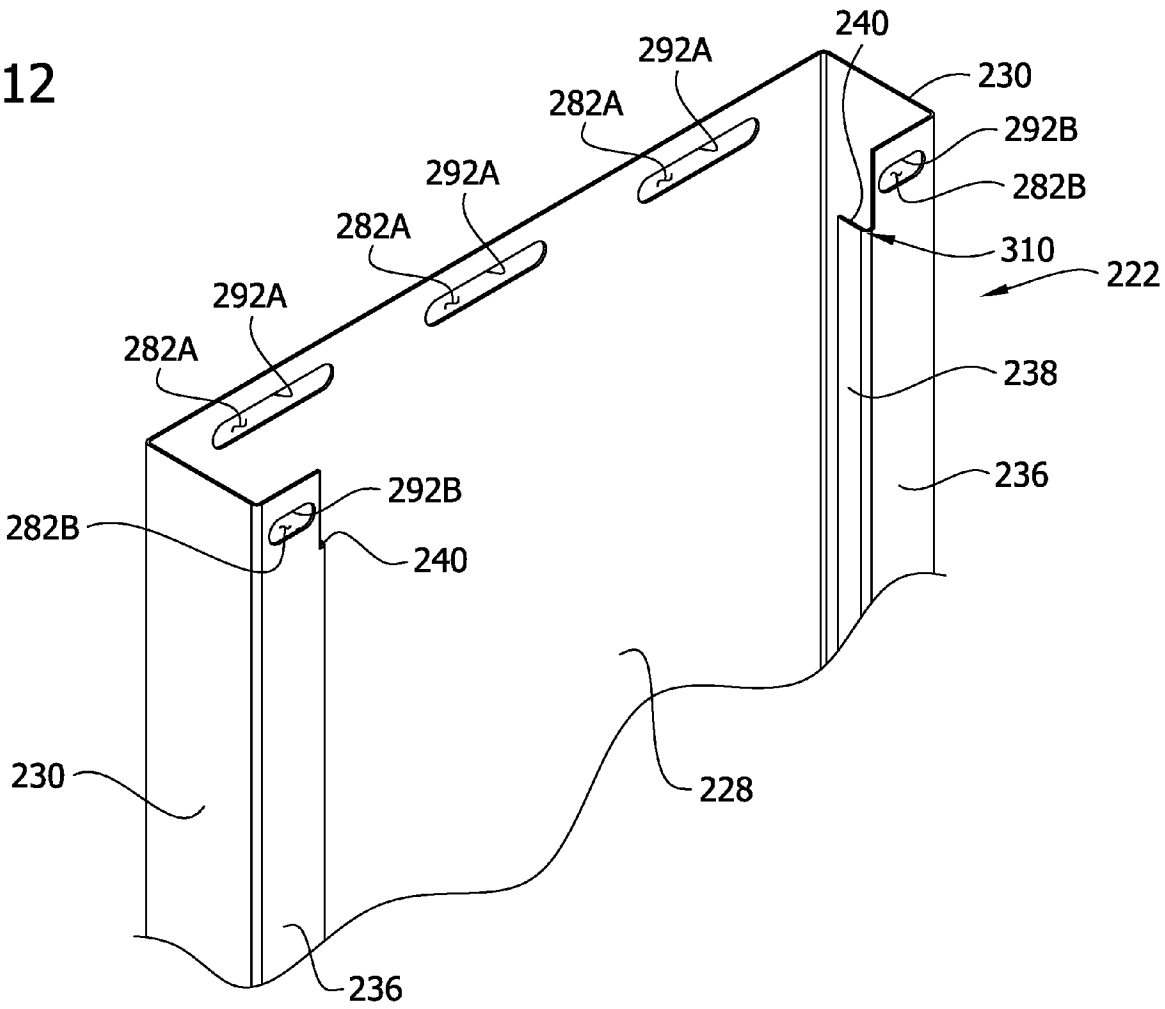
FIG. 12 is a perspective of an upper portion of an upper panel member of the mine stopping panel of FIG. 9.
Figure 13:
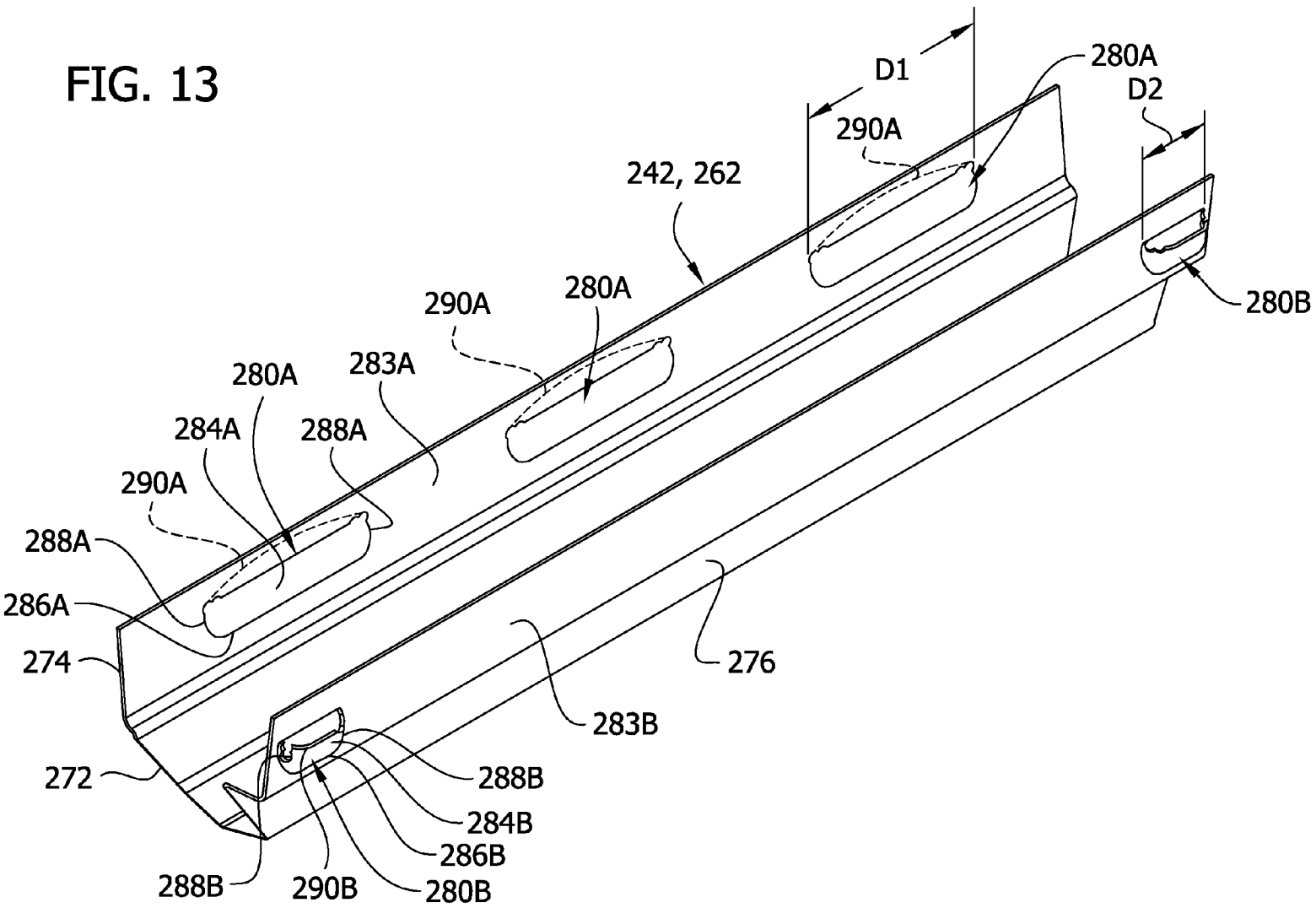
FIG. 13 is a perspective of an upper end cap of the stopping panel of FIG. 9.
Figure 14:
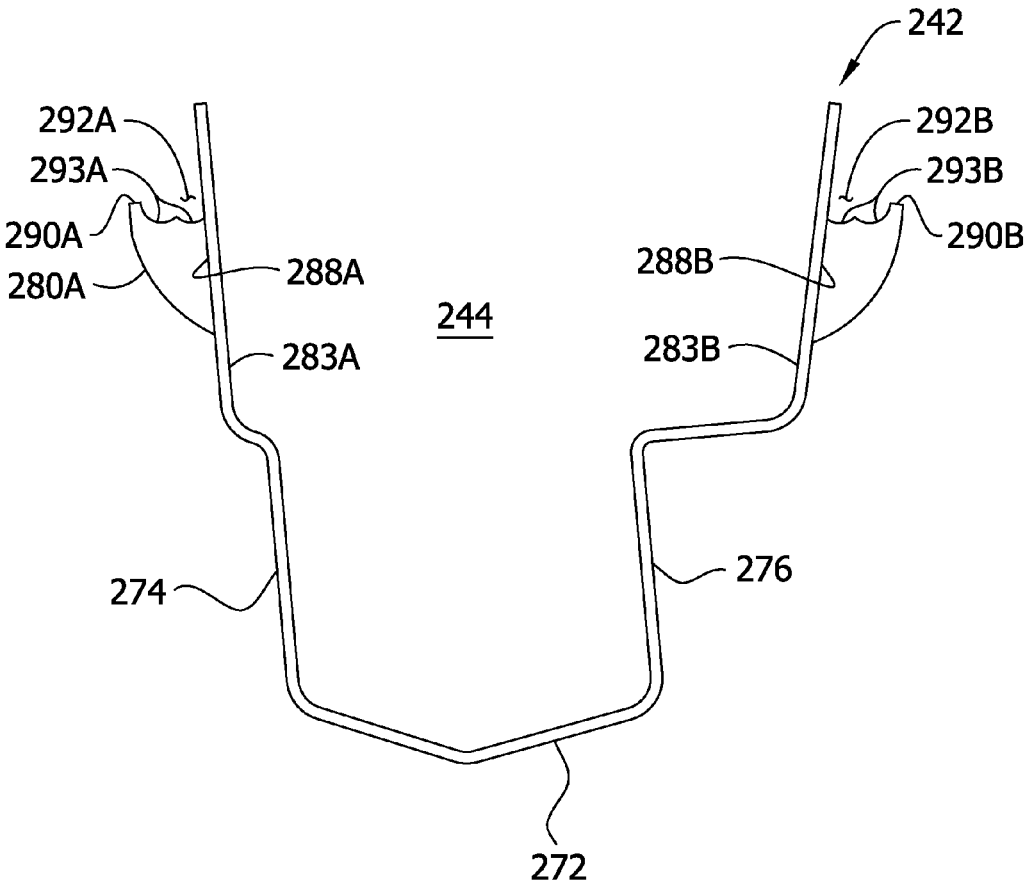
FIG. 14 is a left end elevation of the upper end cap of FIG. 13.

First, the louver connections 260A, 260B have a different configuration. As illustrated in FIGS. 10, 11, and 14, the louver bodies 284A, 284B on the upper end cap 242 have free edges 290A, 290B configured to have scalloped recesses or grooves 294A, 294B for receiving the opposing edges 292A, 294B of the louver openings 282A, 282B in the panel member 222. The reception of the edges 294A, 294B in the grooves 294A, 294B minimizes rotation (roll) of the end cap 242 relative to the panel member 222. The louver connections between the lower end cap and the lower panel member (not shown) are configured in the same way.

The second difference is the stop arrangement for limiting telescopic movement of the upper end cap 242 relative to the upper panel member 222 when a contracting (downward) force is applied to the upper end cap, and for limiting telescopic movement of the lower end cap (not shown) relative to the lower panel member (not shown) when a contracting (downward) force is applied to the lower end cap. In the second embodiment of stopping panel 220, illustrated in FIGS. 9-14, the stops 310 for limiting telescopic movement of the upper end cap 242 relative to the upper panel member 222 when a contracting (downward) force is applied to the upper end cap are formed by the upper terminal edges 240 of the edge margins 238 of the in-turned lips 236 of the panel member 222. In particular, the shoulder 278 of the upper end cap 242 engages the upper terminal edges 240 to limit downward telescopic movement of the end cap relative to the upper panel member 222 when the contracting (downward) force F3 is applied to the upper end cap. Similarly, the shoulder of the lower end cap engages the lower terminal edges of the edge margins 238 of the in-turned lips 236 of the panel member 222 to limit upward telescopic movement of the lower end cap relative to the lower panel member when the contracting (downward) force is applied to the lower end cap. (FIG. 9 does not show the lower end cap or the lower terminal edges of the edge margins 238 of the in-turned lips 236 of the panel member 222, but these elements are identical to the corresponding elements 62, 41 of the panel 20 of the first embodiment.)

Other louver connection configurations and stop configurations are possible. Also, while the mine stopping panels 20, 220 described have upper and lower end caps 42, 62 both of which have louver connections with respective panel members 22, 24, it will be understood that one of the end caps can have louver connections with its respective panel member and the other end cap can have another type of connection with its respective panel member.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying drawing shall be interpreted as illustrative and not in a limiting sense.

What is claimed is:

1. A mine stopping panel comprising first and second elongate panel members of channel shape, each panel member having a web, first and second flanges at opposite sides of the web, and in-turned lips at outer edges of the flanges, said first and second panel members having a telescoping sliding fit one inside the other along an axis extending lengthwise of the panel members, an elongate first end cap extending between the first and second flanges of the first panel member on an inside surface of the web of the first panel member, said first end cap defining a first cavity for receiving a first end seal for sealing engagement with a first mine surface;

a first set of one or more louver connections between the first panel member and the first end cap holding the first end cap against movement relative to the first panel member when an extending force is applied to the first end cap tending to telescopically extend the first panel member relative to the second panel member in a first direction along said axis to bring the first seal into pressure engagement with said first mine surface, each of said one or more louver connections comprising a louver projecting through a louver opening.

2. A mine stopping panel as set forth in claim 1, wherein the louver opening is in the first panel member and the louver is on the first end cap projecting outward through the louver opening.

3. A mine stopping panel as set forth in claim 1, wherein said first set of one or more louver connections does not hold the first end cap against movement relative to the first panel member when a contracting force is applied to the first end cap tending to telescopically contract the first panel member relative to the second panel member in a second direction along said axis opposite said first direction.

4. A mine stopping panel as set forth in claim 3, further comprising at least one stop on the first panel member configured for engagement by the first end cap to limit telescopic movement of the first end cap relative to the first panel member when said contracting force is applied to the first end cap.

5. A mine stopping panel as set forth in claim 4, wherein the at least one stop is a tab formed as an integral part of the first panel member bent to a position for engagement by the first end cap.

6. A mine stopping panel as set forth in claim 3, wherein the in-turned lips of the first panel member have in-turned edge margins extending toward the web of the first panel member, said in-turned edge margins having end edges located for engagement by the first end cap to limit telescopic movement of the first end cap relative to the first panel member when said contracting force is applied to the first end cap.

7. A mine stopping panel as set forth in claim 1, wherein the louver of said louver connection is struck from a first region of the first end cap or the first panel member to have a louver body having a base edge integrally joined to the first region, opposite side edges integrally joined to the first region, and a free edge opposite the base edge projecting outward from the first region for engagement by an opposing edge of said louver opening when said extending force is applied to the first end cap.

8. A mine stopping panel as set forth in claim 7, wherein said free edge of the louver body is configured to define a slot for receiving said opposing edge of said louver opening.

9. A mine stopping panel as set forth in claim 8, wherein said free edge has grooves in it for receiving said opposing edge of said louver opening.

10. A mine stopping panel as set forth in claim 1, wherein the first end cap has a base wall and first and second opposite side walls extending from the base wall to define the first cavity for receiving the first seal, said first set of one or more louver connections comprising at least one louver connection between the first side wall of the first end cap and the web of the first panel member, and at least one louver connection between the second side wall of the first end cap and at least one of the in-turned lips of the first panel member.

11. A mine stopping panel as set forth in claim 1, further comprising an elongate second end cap extending between the first and second flanges of the second panel member on an inside surface of the web of the second panel member, said second end cap defining a second cavity for receiving a second seal for sealing engagement with a second mine surface opposite the first mine surface;

a second set of one or more louver connections between the second panel member and the second end cap holding the second end cap against movement relative to the second panel member when an extending force is applied to the second end cap tending to telescopically extend the second panel member relative to the first panel member in a direction along said axis to bring the second seal into pressure engagement with said second mine surface, each of the one or more louver connections of the second set comprising a second louver projecting through a second louver opening.

12. A mine stopping panel as set forth in claim 11, wherein the second louver opening is in the second panel member and the second louver is on the second end cap and projects outward through the second louver opening.

13. A mine stopping panel as set forth in claim 11, wherein said second set of one or more louver connections does not hold the second end cap against movement relative to the second panel member when a contracting force is applied to the second end cap tending to telescopically contract the second panel member relative to the first panel member along said axis.

14. A mine stopping panel as set forth in claim 11, further comprising at least one stop on the second panel member configured for engagement by the second end cap to limit telescopic movement of the second end cap relative to the second panel member when said contracting force is applied to the second end cap.

15. A mine stopping panel as set forth in claim 14, wherein the at least one stop is a tab formed as an integral part of the second panel member bent to a position for engagement by the second end cap.

16. A mine stopping panel as set forth in claim 13, wherein the in-turned lips of the second panel member have in-turned edge margins extending toward the web of the second panel member, said in-turned edge margins having end edges located for engagement by the second end cap to limit telescopic movement of the second end cap relative to the second panel member when said contracting force is applied to the second end cap.

17. A mine stopping panel as set forth in claim 11, wherein the second end cap has a base wall and first and second opposite side walls extending from the base wall to define said second cavity for receiving the second seal, said second set of one or more louver connections comprising at least one louver connection between the first side wall of the second end cap and the web of the second panel member, and at least one louver connection between the second side wall of the second end cap and at least one of the in-turned lips of the second panel member.

18. A mine stopping panel comprising first and second elongate panel members of channel shape, each panel member having a web, first and second flanges at opposite sides of the web, and in-turned lips at outer edges of the flanges, said first and second panel members having a telescoping sliding fit one inside the other along an axis extending lengthwise of the panel members, a first end cap extends between the first and second flanges of the first panel member on an inside surface of the web of the first panel member, a first set of one or more louver connections between the first panel member and the first end cap holding the first end cap against movement relative to the first panel member when an extending force is applied to the first end cap tending to telescopically extend the first panel member relative to the second panel member in a first direction along said axis, each of said one or more louver connections comprising a louver projecting through a louver opening, and wherein the louver of said louver connection is struck from a first region of the first end cap or the first panel member to have a louver body having a base edge integrally joined to the first region, opposite side edges integrally joined to the first region, and a free edge opposite the base edge projecting outward from the first region for engagement by an opposing edge of said louver opening when said extending force is applied to the first end cap.

19. A mine stopping panel as set forth in claim 18, wherein the first end cap defines a first cavity for receiving a first end seal for sealing engagement with a first mine surface.

20. A mine stopping panel as set forth in claim 19, wherein the louver opening is in the first panel member and the louver is on the first end cap projecting outward through the louver opening.

* * * * *